United States Patent [19]

DeAmicis

[11] 4,028,968

[45] June 14, 1977

[54] DISTRIBUTOR ADJUSTMENT TOOL

[76] Inventor: Ferdinando DeAmicis, 294 Hodder Ave., Thunder Bay, Ontario, Canada

[22] Filed: Dec. 24, 1975

[21] Appl. No.: 644,345

[52] U.S. Cl. ..... 81/71

[51] Int. Cl.[2] ..... B25B 13/48

[58] Field of Search ..... 81/71, 177.8, 177 ST

[56] References Cited

UNITED STATES PATENTS

| | | | |
|---|---|---|---|
| 2,933,963 | 4/1960 | Blasdell | 81/177.8 |
| 2,951,405 | 9/1960 | Engquist | 81/71 |

*Primary Examiner*—James L. Jones, Jr.

*Attorney, Agent, or Firm*—H. Dale Palmatier

[57] ABSTRACT

A tool for adjusting the ignition point assembly of an automotive engine. The tool includes a handle with a hand grip on one end and a hexagonal-headed tool bar pivotally attached to the other end. Rigidifying means are provided to stiffen the pivotal connection so that when the tool is supported horizontally by the bar, the handle will not swing, by its own weight, about the pivotal connection. The tool includes a projection adjacent the hexagonal bar end for lifting the access door of a distributor so that the hexagonal bar end may enter and engage an adjustment screw in the distributor.

1 Claim, 8 Drawing Figures

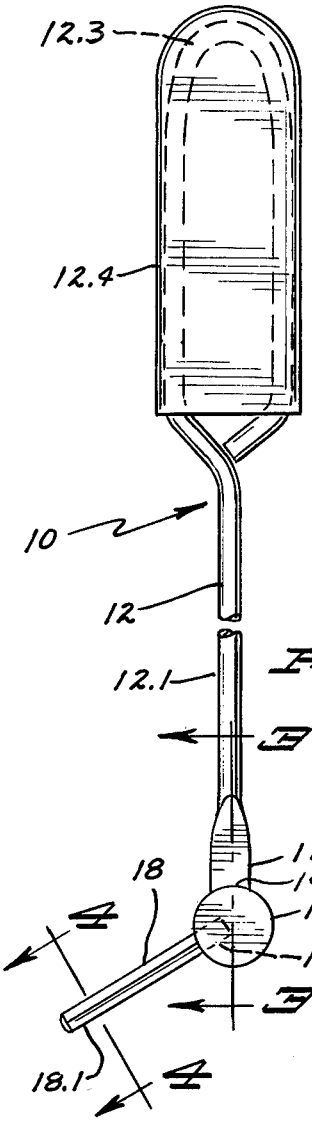
FIG. 1
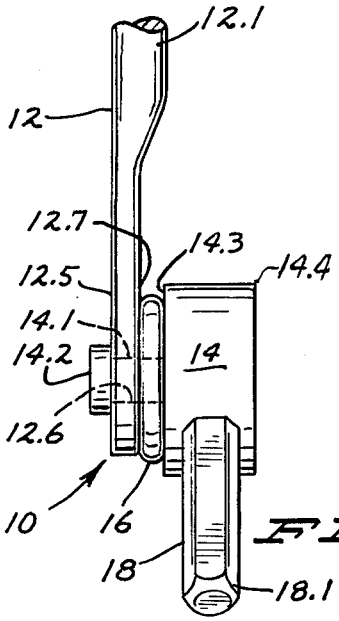
FIG. 2
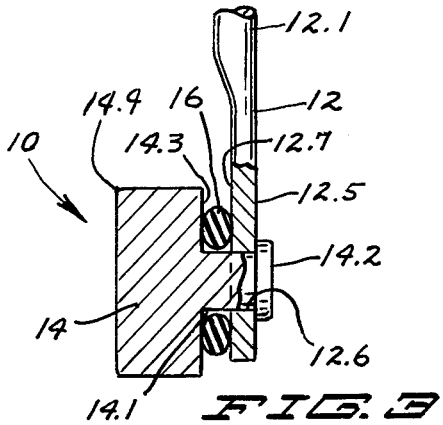
FIG. 3
FIG. 4
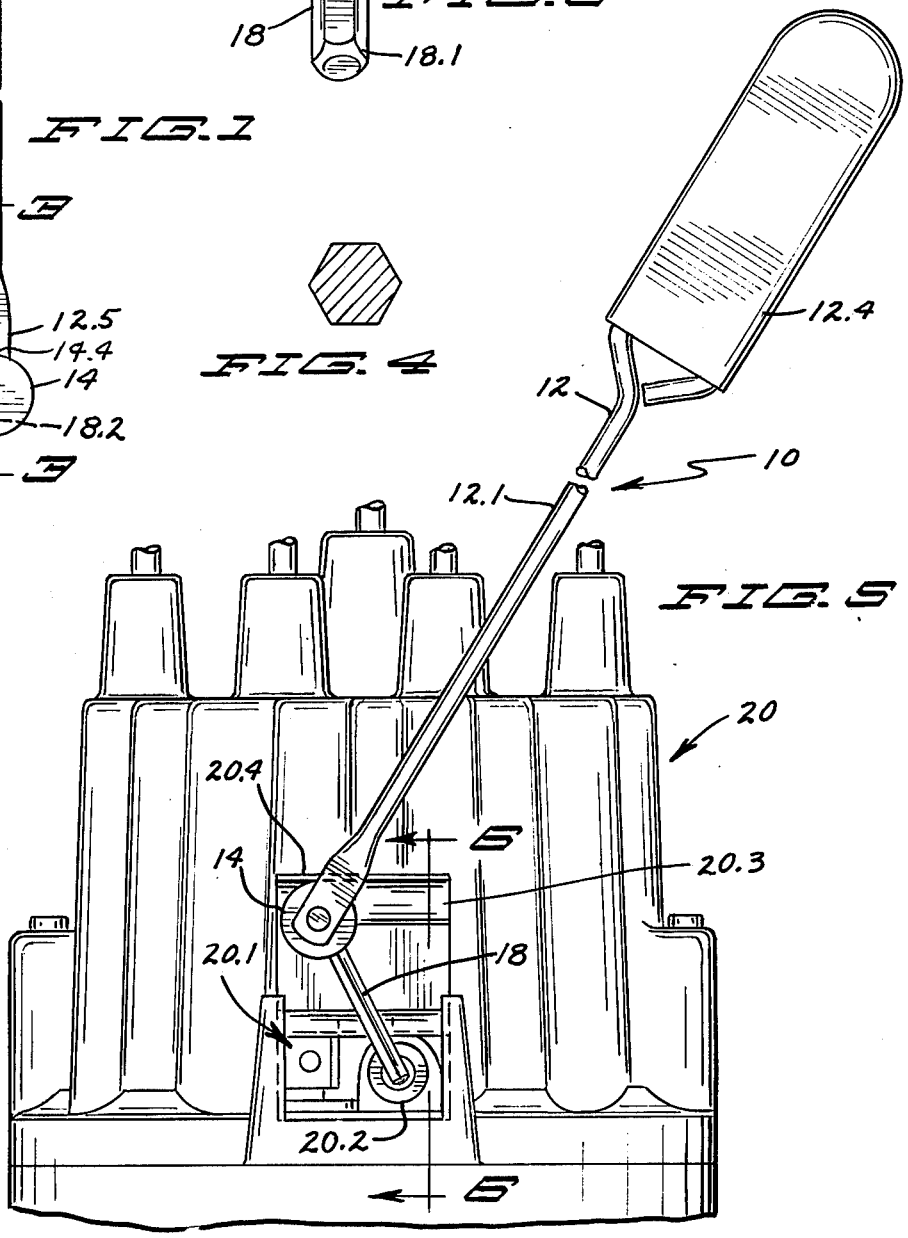
FIG. 5

DISTRIBUTOR ADJUSTMENT TOOL

BACKGROUND OF THE INVENTION

In many automobiles, especially those made by the General Motors Corporation, the dwell time of the ignition system is adjustable by turning of an adjustment screw located within the distributor and accessible through a small access door leading into the distributor. Often, access to the door is difficult due to obstructions surrounding the distributor and because of the nearness of the distributor to the fan. Wrenches supported at the ends of flexible cables have been devised as tools for adjusting the dwell time as an engine is running, but such cable-driven tools are difficult to use because of the limited flexibility of the cables and because the vibrations from an operating engine tend to make the tools fall out whereby the tools may become dangerously fouled in the fan blades. Moreover, since a mechanic in the process of adjusting the ignition system of an automobile must observe a dwell meter and must manage a strobe light to see the timing mark and must also adjust the timing, it is difficult to also manually hold a cable wrench in position to keep it from falling out of the distributor. Further, it is often difficult to open the small door into the distributor, particularly while the engine is running, and to hold the door open while the wrench end of the cable is inserted.

A simple and inexpensive wrench which would open the access door in the distributor so as to permit entry of a hexagonal wrench end, which would not fall from the engine because of engine vibration, which would easily pass into the cramped quarters surrounding a distributor access door, and which could be left in place unattended while a mechanic attended to other duties, is much to be desired.

SUMMARY OF THE INVENTION

The present invention provides a tool for adjusting the distributor of an automobile engine which comprises a manually graspable, thin handle, and a tool rod pivotally mounted at one end to the handle for rotation through an angle of at least 200°, and having an outwardly projecting end terminating in an allen (hexagonal) head fitting into the dwell time adjustment screw of an automotive ignition point assembly. Rigidifying means, such as an O-ring or lock washer, are provided to rigidify the pivotal connection between the handle and rod so that when the tool is supported solely by the tool rod with the latter in a horizontal position, the rigidifying means prevents pivotal movement of the handle under its own weight. The tool includes a projection adjacent the allen head having an edge spaced from the axis of the rod and oriented to engage the access door of an ignition point assembly to open the latter, whereby the allen head may be manipulated to engage and adjust, through the open door, the ignition dwell adjustment screw.

In its preferred embodiment, the handle comprises a length of heavy wire having a central shank, an upper end defining a manually graspable portion, and a flattened lower end with a hole therethrough. A cylindrical tool mounting block is provided with an axle extending axially from one side and has a sharp-edged circumferential surface providing a distributor door-lifting protuberance. The axle extends through the hole in the handle and is pivotally pinned thereto. A friction fitting such as an O-ring of rubber or similar material is provided about the axle between the flat, confronting surfaces of the shank and mounting block and is squeezed therebetween. The tool rod extends radially into and is affixed to the mounting block so that as the mounting block pivots about its axis, the angle between the handle and rod is changed without changing the distance between the allen head and the door-lifting protuberance.

IN THE DRAWING

FIG. 1 is a front elevational view of a tool of the invention, shown partly broken away;

FIG. 2 is a broken away side view of the tool of FIG. 1;

FIG. 3 is a broken away, cross section view taken along line 3—3 of FIG. 1;

FIG. 4 is a cross section view taken along line 4—4 of FIG. 1;

FIG. 5 is an elevational view of the tool of the present invention as it lifts the access door of an automobile distributor;

DETAILED DESCRIPTION

Figure 6:
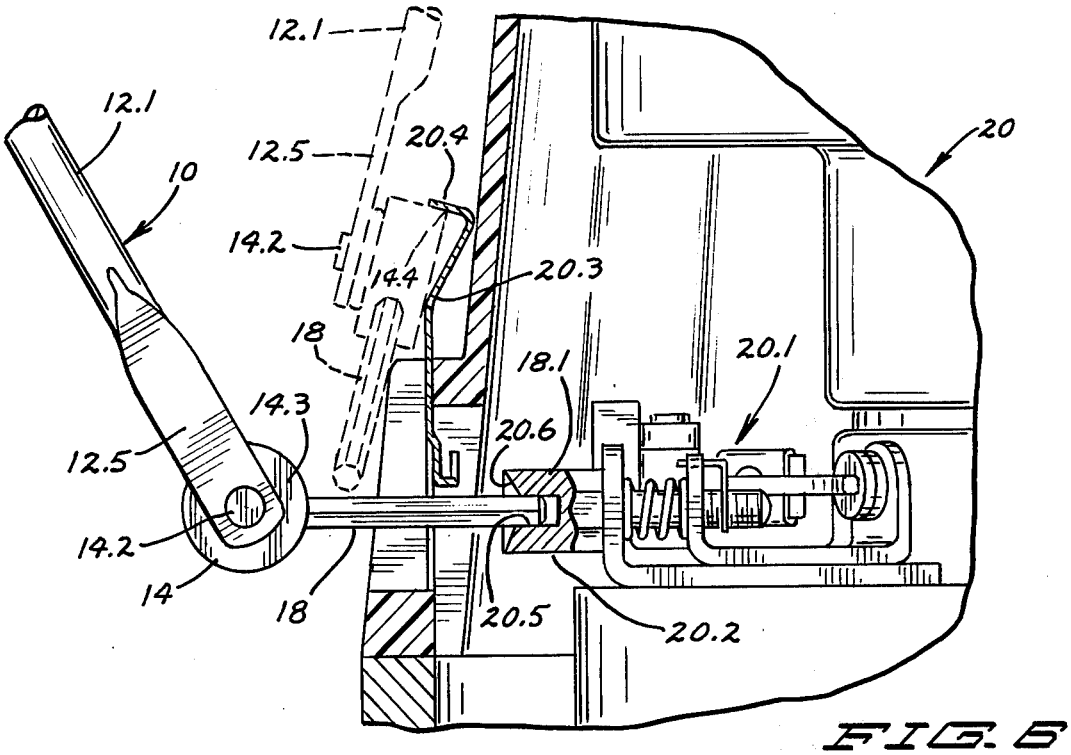
FIG. 6 illustrates the tool of FIG. 5 turned into position for adjusting the ignition point assembly of an automobile distributor.

With reference to FIGS. 1–4, the tool of the invention is designated generally as 10 and includes a handle 12 formed of a length of stiff wire and having a central straight shank 12.1. At its upper end, the wire is doubled back to form an inverted U, as shown in FIG. 1, to define a manually graspable portion 12.3 which may be covered with an insulating plastic sleeve 12.4. At its lower end, the wire terminates in a flattened section 12.5 with a hole 12.6 therethrough. p A sharp-edged cylindrical mounting block 14 is provided with an axle 14.1 extending axially from one of its flat surfaces 14.3. The axle passes through the hole 12.6 in the flattened end of the wire handle and is provided with a flattened, expanded end 14.2 which is of greater diameter than the hole 12.6 and which retains the axle rotatably within the hole, the one flat surface 14.3 of the mounting block being parallel to and confronting the nearer flat surface 12.7 of the lower end of the handle. An O-ring 16, desirably of resilient material such as rubber, is provided about the axle 14.1 and is squeezed tightly between the confronting surfaces 12.7, 14.3 of the handle and mounting block, respectively, the O-ring frictionally restraining the mounting block from turning about its axis with respect to the handle, as will be explained in more detail below.

A tool bar 18 of hexagonal cross section provides a hexagonal "allen" wrench 18.1 at one end and has its other end 18.2 (FIG. 1) received within a hole formed radially in the circumference of the mounting block 14 and there affixed to the block by adhesive, solder or the like. The tool bar 18 is much shorter, e.g., one-sixth, the length of the handle, and is generally of thinner material than the handle wire. As a result, the center of balance of the tool is nearer the handle grip than the allen head, and may be approximately midway along the handle length. Although the tool bar 18 is depicted as having a hexagonal cross section (FIG. 4) throughout its length, it will be understood that only the allen wrench end of the bar need be hexagonal.

Figure 7:
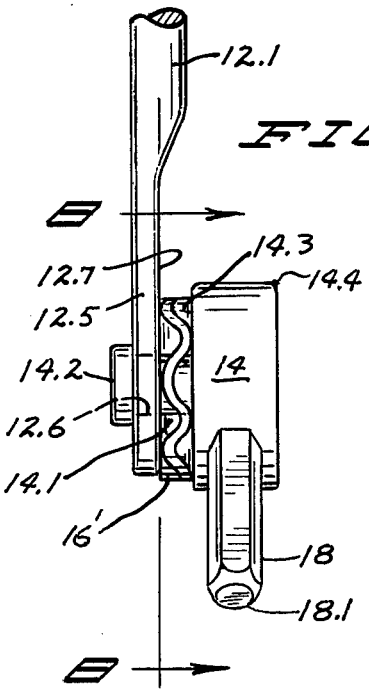
FIG. 7 is a broken away elevational view of a modified form of the tool of the invention.
Figure 8:
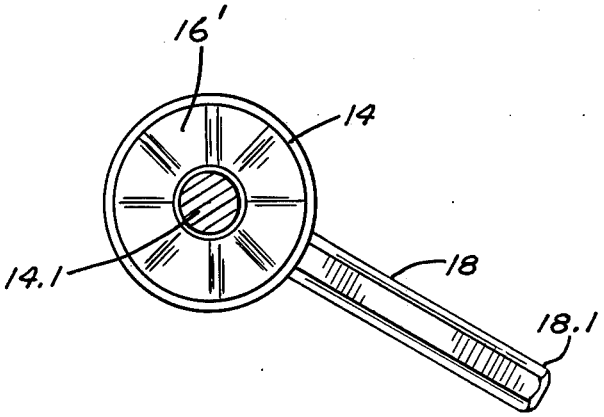
FIG. 8 is a cross section view taken along line 8—8 of FIG. 7.

FIGS. 7–8 depict en embodiment of my tool in which the rigidifying means is a lock washer 16' having radially extending convolutions producing a frictional resilient contact between the confronting surfaces of the handle and mounting block.

The thus described pivotal attachment of the tool bar to the handle permits the tool bar to rotate through an angle of at least 200° with respect to the handle. In the embodiment depicted in FIG. 2, this angle of rotation is 360° due to the offset of the tool bar from the handle by virtue of the mounting block assembly.

FIGS. 5 and 6 depict the tool 10 of the invention in use. A distributor 20 for late model General Motors Corporation automobiles is shown broken away, the distributor having an ignition point assembly designated generally 20.1. The assembly 20.1 includes an adjustment screw 20.2 for setting the dwell time. Located at one side of the distributor 20, generally adjacent the fan (not shown) is an access door 20.3 having an outwardly extending upper lip 20.4 and which opens by sliding upwardly. The adjustment screw 20.2 has an allen wrench-receiving axial hole 20.5 which faces the access door and which has an outwardly tapered rim 20.6 adapted to guide an allen wrench into the opening 20.5.

As will be appreciated from FIG. 6, the tool mounting block 14 defines a protuberance provided with a sharp, outer edge 14.4 for contacting and bearing against the lip 20.4 of the distributor access door in a slip-free manner. Although door-contacting protuberances of various configurations can be employed, the sharp-edged cylindrical bearing block is preferred because of its ease of manufacture and because the distance between the door-contacting sharp edge 14.4 and the allen head 18.1 remains constant and is independent of the angle between the handle 12 and the tool bar 18, as will be explained more fully below.

The tool bar preferably extends from the circumferential surface of the mounting block a distance of approximately one inch, and the mounting block may have a diameter of approximately one-half inch and a thickness of about one-fourth inch.

The rigidifying means, shown as an O-ring in FIGS. 1-6 and as a lock washer in FIGS. 7 and 8, frictionally retards or restrains angular movement of the tool bar with respect to the handle so that this angular relationship may be changed only with some manual effort. The restraint to such angular movement provided by the rigidifying means is sufficiently great to prevent relative movement between the handle and tool bar due to the weight of the handle when the tool bar is supported in a horizontal position, regardless of the orientation of the handle.

In use, the tool of the invention is set so that the tool bar makes an angle of, for example, 110° with the handle shank 12.1. The tool is then positioned adjacent the access door of an automotive distributor with the tool bar lying along the side of the distributor cover and with the sharp edge 14.4 of the mounting block 14 in position below the lip 20.4 of the access door. The tool is then lifted, the edge 14.4 of the mounting block contacting and lifting upwardly the access door 20.3 into its open position, as shown best in FIG. 5 and in phantom lines in FIG. 6. While the door is thus held open, the handle 12 is rotated about the axis of the shank 12.1 so that the tool bar slips beneath the raised door. Entry of the allen head 18.1 into the hole 20.5 of the adjustment screw is aided by the tapered rim 20.6 of the hole, the tool being manipulated into the position shown in solid lines in FIG. 6. In the latter, adjustment position, the mounting block is spaced outwardly slightly from the distributor a short distance so as not to interfere with operation of the tool as adjustment proceeds, and the tool bar keeps the access door from falling shut.

With the allen head inserted in the screw opening, the mechanic may release the handle and attend to other steps in the timing procedure. By virtue of the frictional affect of the O-ring or other rigidifying means, the handle remains in the angular orientation with respect to the tool bar as was previously set by the mechanic. I have found, surprisingly, that if the angle between the tool rod and handle is greater than about 90° and if the handle is in a vertical plane or in a plane within about 30° of vertical, the vibration of the engine causes the allen head to work its way further into, rather than out of, the hole in the adjustment screw. Thus, the mechanic may leave the tool unattended without concern that the tool will vibrate loose from the adjustment screw and fall out into the blades of the fan or the like.

When the mechanic finishes his procedure, the tool is removed and the access door falls into its closed position, aided, if necessary, by the tool. The tool may then be folded in jackknife fashion with the tool bar lying back adjacent the shank of the handle for convenient storage.

While I have described a preferred embodiment of the present invention, it should be understood that various changes, adaptations, and modifications may be made therein without departing from the spirit of the invention and the scope of the appended claims.

What is claimed:

1. A tool for adjusting an automotive engine ignition point assembly confined behind a vertically sliding guillotine door with a flanged lower edge, comprising a handle, a hexagonal-headed tool bar pivotally attached to one end of the handle, and means rigidifying the pivotal connection between the handle and tool bar, the handle having an elongate shank with a flattened lower end and also having a looped upper end to be manually gripped and oriented substantially parallel to said flattened lower end and also lying substantially parallel to the plane in which said pivotally attached tool bar swings, the hexagonal-headed tool bar being elongate and linear in shape and lying in a plane parallel to and at one side of the handle and of the flattened lower end thereof, the tool bar including a cylindrical hub located entirely at one side of the flattened lower end of the handle and projecting significantly transversely outwardly from said flattened lower end, the hub also including a reduced neck rotatable in and affixed to said flattened lower end of the handle, there being a peripheral space around said neck and between the hub and the flattened end of the handle, the cylindrical hub and neck having a common axis extending perpendicular to the plane of the handle and of said flattened lower end, and said rigidifying means including a resilient friction washer surrounding said neck and located in said peripheral space, and bearing resiliently and under pressure against both the flattened lower end of the handle and against the cylindrical hub and creating a significant frictional relationship to retain the hub and tool bar in any desired position relative to the handle, the hub being continuously located at the same position relative to the handle and with a prefixed orientation relative to the loop and the flattened lower end of the handle to permit the hub to effectively lift the guillotine door, regardless of the vertical inclination of the handle while allowing the tool bar to immediately swing into the ignition point assembly for making the desired adjustment.

* * * * *